US008978787B2

(12) United States Patent
Ersan et al.

(10) Patent No.: US 8,978,787 B2
(45) **Date of Patent: *Mar. 17, 2015**

(54) TURBINE DRIVEN REAMING BIT WITH BLADES AND CUTTING STRUCTURE EXTENDING INTO CONCAVE NOSE

(75) Inventors: Silvino M. Ersan, Houston, TX (US); Anthony Phillips, The Woodlands, TX (US); Maurilio V. Solano, Houston, TX (US); Rudolf C. Pessier, Houston, TX (US); Thorsten Schwefe, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 345 days.

This patent is subject to a terminal disclaimer.

(21) Appl. No.: 13/349,246

(22) Filed: Jan. 12, 2012

(65) Prior Publication Data

US 2013/0180782 A1 Jul. 18, 2013

(51) Int. Cl.

| | |
|---|---|
| ***E21B 10/26*** | (2006.01) |
| ***E21B 4/02*** | (2006.01) |
| ***E21B 7/20*** | (2006.01) |
| ***E21B 10/54*** | (2006.01) |

(52) U.S. Cl.

CPC . *E21B 10/26* (2013.01); *E21B 7/20* (2013.01); *E21B 10/54* (2013.01)

USPC ..... 175/406; 175/92; 175/377

(58) Field of Classification Search

CPC ..... E21B 10/26; E21B 10/43; E21B 7/28; E21B 17/1092

USPC ..... 175/92, 406, 408, 344, 391, 377

See application file for complete search history.

(56) References Cited

U.S. PATENT DOCUMENTS

| | | | | |
|---|---|---|---|---|
| 7,819,208 | B2 | 10/2010 | Pessier et al. | |
| 7,896,106 | B2 * | 3/2011 | Gavia | 175/57 |
| 8,051,923 | B2 * | 11/2011 | Chen et al. | 175/57 |
| 8,172,010 | B2 * | 5/2012 | Strachan | 175/391 |
| 8,230,952 | B2 * | 7/2012 | Schwefe et al. | 175/408 |
| 8,356,679 | B2 * | 1/2013 | Chen et al. | 175/408 |
| 2008/0135297 | A1 * | 6/2008 | Gavia | 175/57 |
| 2008/0149398 | A1 * | 6/2008 | Azar | 175/406 |
| 2009/0032309 | A1 * | 2/2009 | Schwefe et al. | 175/408 |
| 2011/0000714 | A1 | 1/2011 | Durairajan et al. | |
| 2011/0083906 | A1 | 4/2011 | Hall et al. | |
| 2011/0100723 | A1 * | 5/2011 | Scott et al. | 175/406 |
| 2012/0152624 | A1 * | 6/2012 | Chen | 175/428 |
| 2013/0180781 | A1 * | 7/2013 | Ersan et al. | 175/107 |

(Continued)

OTHER PUBLICATIONS

Baker Hughes, EZReam—Competition, date unknown, 1 page.

(Continued)

*Primary Examiner* — Jennifer H Gay

(74) *Attorney, Agent, or Firm* — Steve Rosenblatt

(57) ABSTRACT

A reaming bit designed to operate with low torque fluctuation when driven with a turbine at speeds in the order of 300-600 RPM and above features a profile that is arcuate from the gauge dimension to the nose area or alternatively has a blunt straight taper section but with a ratio of profile length (PL) to bit size (BS) of under 0.75. The blades extend into a concave cone and the cutting structure continues along the blades towards the center. The blades have a step near the gauge section to increase the exposure of the blade cutting structure. An array of protrusions are disposed parallel to and behind the cutting structure to increase high speed stability and adjacent the blade step transition to protect outer casing on run in.

12 Claims, 5 Drawing Sheets

(56) References Cited

U.S. PATENT DOCUMENTS

| | | | | |
|---|---|---|---|---|
| 2013/0180782 | A1* | 7/2013 | Ersan et al. | 175/406 |
| 2013/0180783 | A1* | 7/2013 | Ersan et al. | 175/406 |

OTHER PUBLICATIONS

Weatherford Drilling & Intervention Services, BBL ReamerShoe and DiamondBack ReamerShoe, 2002, 2 pages.
Technology Applications, 1 page.
Deep Casingtools, Turbocaser Express, date unknown, 1 page.
Weatherford International, CleanReam Reaming Shoe, 2007, 2 pages.
Deep Casingtools, Turborunner Case Study: Central North Sea, Saxon Field, date unknown, 2 page.
Wedge (mechanical device), Wikipedia, Jan. 4, 2012, 4 pages.
Screw—Fasteners with a tapered shank (self-threading screws), Wikipedia, Jan. 4, 2012, 5 pages.

* cited by examiner

TURBINE DRIVEN REAMING BIT WITH BLADES AND CUTTING STRUCTURE EXTENDING INTO CONCAVE NOSE

FIELD OF THE INVENTION

The field of the invention is reaming bits and more particularly those used on high speed, low torque turbines or motors attached to the leading end of a casing or liner string. The bits having profile characteristics that reduce torque fluctuations due to unpredictable variations in weight on bit.

BACKGROUND OF THE INVENTION

When running a casing or liner into a predrilled bore hole, it is desirable that the bore hole will have been drilled with the intended shape, to its designed diameter, and without marked deviations, such as doglegs, along its path. Unfortunately, due to unstable, heterogeneous formations, irregularities such as stringers within a formation, poor drilling practices, damage and wear of drill bits and bottom hole assemblies (BHA) and various other factors, the ideal bore hole is rarely achieved.

Therefore, it is desirable to provide the casing or liner string being run into the existing bore hole with a cutting structure at the leading end thereof to enable enlargement, as necessary, of portions of the bore hole so that the casing or liner may be run smoothly into the bore hole to the full extent intended. Initially the entire liner or casing string was rotated while it was being lowered into the borehole, which required powerful and complex drive systems at the surface. More recent projects use a hollow turbine or motor at the leading end of the casing string which are driven by drilling fluid pumped from the surface. It provides for a more efficient and economical transfer of power from the surface to the drill bit but it also limits the amount of torque that can be delivered to the bit and most of the power is in the form of high rotational speed. This most recent approach of using high speed turbines to provide a casing or liner string with a reaming capability has yielded inconsistent results with conventional, bullet shaped reaming bits.

In U.S. Pat. No. 7,621,351 a reamer bit having a substantially tubular body and a nose portion with a concave center extends from the nose portion to the side wall through a tapered shoulder region. The reaming tool further comprises a cutting structure for enlarging, also termed "reaming," of a bore hole through contact with the side wall thereof. The term "tool" is used herein in a non-limiting sense, and embodiments of the present invention may also be characterized as a reaming bit or reaming shoe. In some embodiments, the nose portion of the reaming tool has at least one port therethrough extending to the interior of the body. In some embodiments, a plurality of circumferentially spaced, spirally configured blades extend on the exterior of the body from proximate the shoulder transition region to the gage and define junk slots there between. An axially leading end of each blade commences with substantially no standoff from the body and tapers radially outwardly to a portion having a substantially constant standoff and having a radially inwardly extending, beveled, axially trailing end. A plurality of cutting elements are disposed along a rotationally leading edge of each blade. The nose of this tool can be drilled out in a related method to allow further completion of the well.

In the past reaming tools that were surface driven turned typically in an RPM range of about 40-80 RPM and the large diameter, stiff casing was able to transmit high levels of torque. Turbines or high speed motors driven at speeds of 300-600 RPM and higher can only supply a fraction of the torque provided by top drives or rotary tables. Due to the lower torque capacity of the turbines the reaming tools that were previously serviceable experienced a great deal of stalling, reduced rates of penetration and generally unreliable performance. Typically these reamers had a bullet shaped profile 10, shown in FIG. 1, from the cylindrical gage dimension 12 to the center 14 of the concave cone section 16 that featured a long tapered segment 18 sandwiched between a curved segment 20 that had one or two radii 22 and a lower curved transition 24 having a radius 26 that forms the leading part or nose of the profile and then continues in a bottom taper 28 that defines a recessed, concave cone 16. In FIG. 1 the profile length (PL) is defined as the distance along the profile between and not including the gauge dimension 12 and the center 14 of the cone 16. The nominal diameter or bit size (BS) is double the distance from the centerline 30 to the gauge dimension 12 in a plane perpendicular to the centerline 30. The range of PL/BS ratios of existing reamer tools that were run in the typical RPM range of 40-80 RPM was in the order of 0.76 to 1.27 for a range of BS of 5.5 to 19.25 inches. In addition to the profile length the inclination a of the long tapered section with respect to the reamer axis 30 is important. It forms a conical wedge in the borehole which provides a mechanical advantage by producing high lateral forces for small changes in axial forces or weight on bit (WOB). The mechanical advantage is proportional to $1/\tan \alpha$ and therefore is quite significant for smaller angles. This is desirable in applications where it is difficult to deliver sufficient WOB to advance the reamer but becomes the source of high torsional oscillations in applications where WOB control is difficult or erratic due to a complex well trajectory, borehole tortuosity, formation heterogeneity and many other operational variables.

While the various reamers described above functioned fairly well at higher torque and slower RPM, the recent advent of a turbine driving a reamer with less torque at significantly higher speeds of 300-600 RPM and above produced an unacceptable level of torque fluctuation and stalling of the turbines. The present invention was developed to address this situation and enhance the performance of reamers in turbine applications by making modifications to the profile and other design features as will be described below. One of the approaches was the profile modification and shortening of the PL by using a plurality of arcuate surfaces between the gauge dimension 12 and bottom taper 28 and eliminating the long, low angle, tapered segment 18 of FIG. 1. Another variation was to retain it but reduce its length and increase the angle of the tapered segment 18 to more than 30 degrees which reduces the aggressiveness and brings the PL/BS ratio to below 0.75. A different source of undesirable vibrations and torsional oscillations at low torque and high rpm is a perfectly symmetrical spacing of blades. Even small variations in the angular spacing between blades will significantly reduce these harmonic vibrations without having to affect the mass balance of the reamer itself. Another feature to assure reliable performance of the reamer was to extend the reamer blades into the concave cone section 16 and add additional fluid ports to enhance bottomhole cleaning. Thus the reamer is capable to effectively drill a full diameter borehole in case the pilot hole gets completely obstructed, is irregularly shaped or is backfilled with cave-ins and/or a cuttings bed in inclined, extended reach wells. Other features were added to the blade structure to protect the outer casing when running the casing or liner string through an already cased upper hole section. The long, spiraled gage pads which are extensions of the blades along the cylindrical section of the reamer bit are designed with smooth but highly wear resistant surfaces to minimize the borehole wall contact stresses and stabilize the bit at high speeds. The upper or trailing end of the gage pad is provided with a single row of active cutting elements for back-reaming while the casing string is moved up and down to condition the borehole and keep the reamer from getting stuck. At the transition from the gage pads to the leading, actively cutting blades the outer surface of the blades includes a peripheral step to allow greater exposure of the primary cutting elements. A series of projections rotationally behind the primary cutting elements limit the depth of cut to further control unintended weight on bit spikes, torsional oscillations and stalling in interbedded, mixed strength formations. These and other features of the present invention will be more readily apparent to those skilled in the art from a review of the detailed description of the preferred embodiment and the associated drawings while recognizing that the full scope of the invention is to be determined from the appended claims.

SUMMARY OF THE INVENTION

A reaming bit designed to operate with low torque fluctuation when driven with a turbine at speeds in the order of 300-600 RPM and above features a profile that is arcuate from the gage dimension to the nose area or alternatively has a greater than 30 degrees, straight taper section and a profile length (PL) to bit size (BS) ratio of under 0.75. The blade spacing is asymmetrical but the reamer itself is mass balanced. The blades extend into a concave cone section towards the center and the cutting structure and nozzle arrangement cover the entire profile to ensure continued drilling if the reamer encounters an obstructed bore hole and/or has to disperse a built-up of cuttings. The blades start with long, smooth and partially spiraled gage pads on the periphery of the reamer and transition into the blade cutting structure with increased exposure, primary cutting elements on the leading edge. An array of protrusions are disposed behind the primary cutting elements to limit depth of cut to further enhance high speed stability and to protect the outer casing on run in.

DETAILED DESCRIPTION OF THE PREFERRED EMBODIMENT

Figure 1:
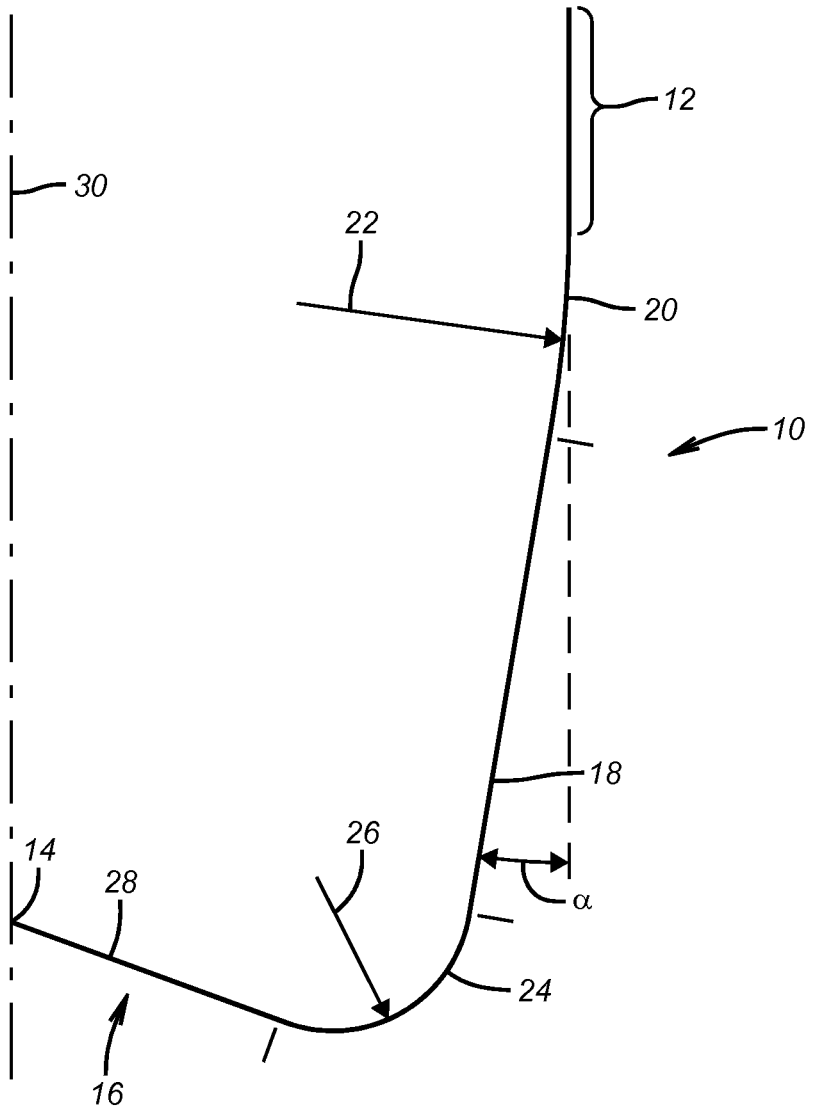
(PRIOR ART) FIG. 1
FIG. 1 is a profile view of an existing reamer tool where the ratio of the profile length to the bit size is over 0.76.
Figure 2:
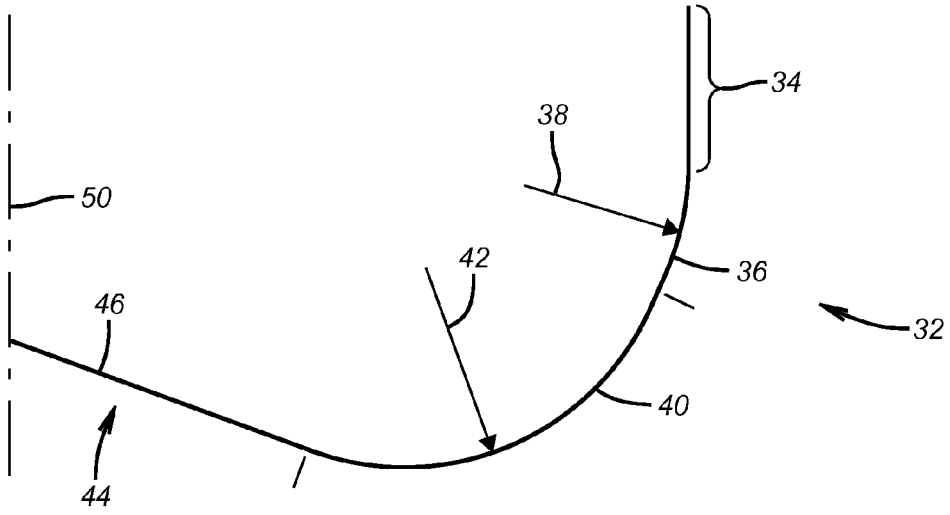
FIG. 2 shows the reamer tool with an arcuate profile from the gage portion to the nose.

FIG. 2 shows a profile 32 that begins below the gage segment 34. The next segment is shown as a single segment 36 with a single radius 38 which is preferably tangent to gage segment 34 but it can also be a plurality of arcuate segments with differing radii, which blend into each other. Transition segment 40 is adjacent to segment or segments 36 and curves around with a radius 42 into the leading part or nose of the profile and joins the tapered segment 46 to define the concave cone 44. Segment 46 extends to the centerline 50. Radius 38 and 42 can also be combined into large, single radius. The profile length (PL) is defined as the sum of the lengths of segment(s) 36, 40 and 46. The bit size (BS) is defined in a plane perpendicular to the centerline 50 and is twice the distance from the centerline 50 to the gauge segment 34 that is preferably cylindrical. The use of an arcuate profile from the gage segment 34 to the nose 44 and the elimination of long, low angle tapered sections allows the reamer tool 48 to be considerably shortened and be less aggressive which is directly related to a reduction of torque fluctuation at the higher speeds and lower depth of cut of a typical turbine drive system. The difference can be readily seen in a comparison of FIGS. 1 and 2.

Figure 3:
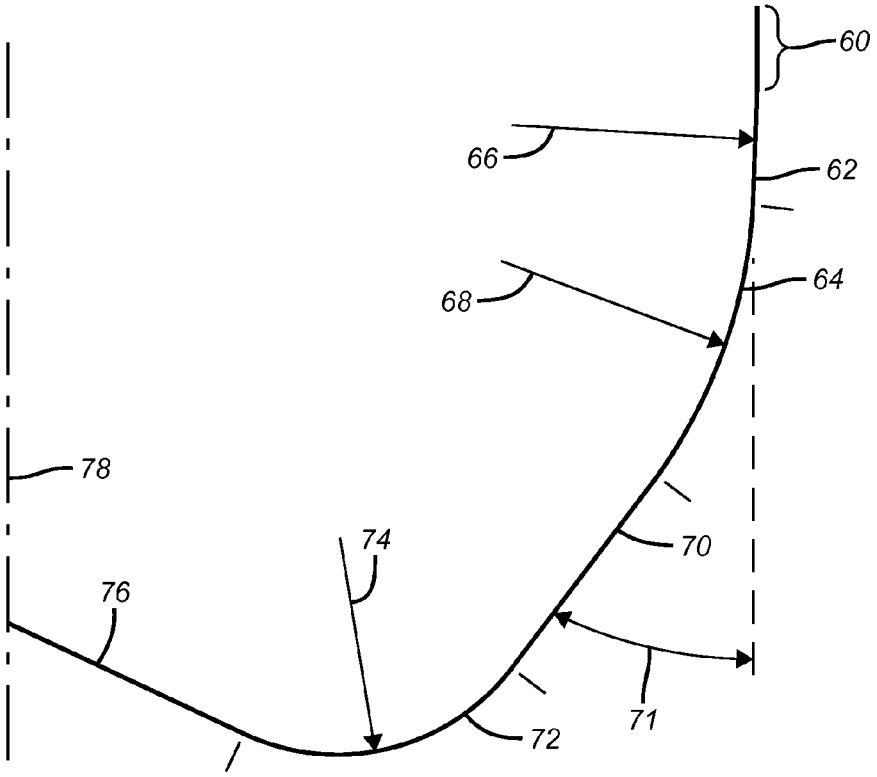
FIG. 3 shows the reamer tool with a straight, high angle taper in the profile and where the ratio of the profile length to the bit size is under 0.76.
Figure 5:
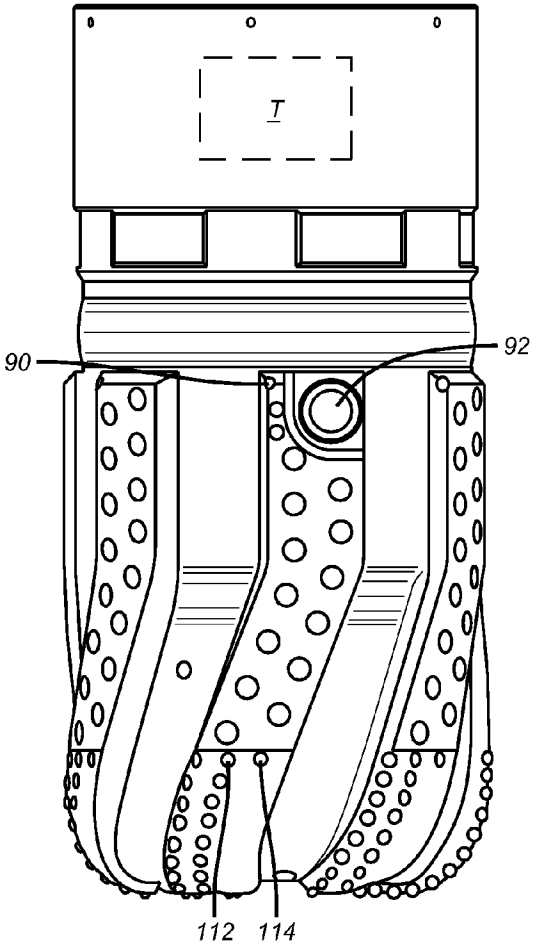
FIG. 5 is a rotated front view from the FIG. 4 orientation showing the rupture disc location.
Figure 7:
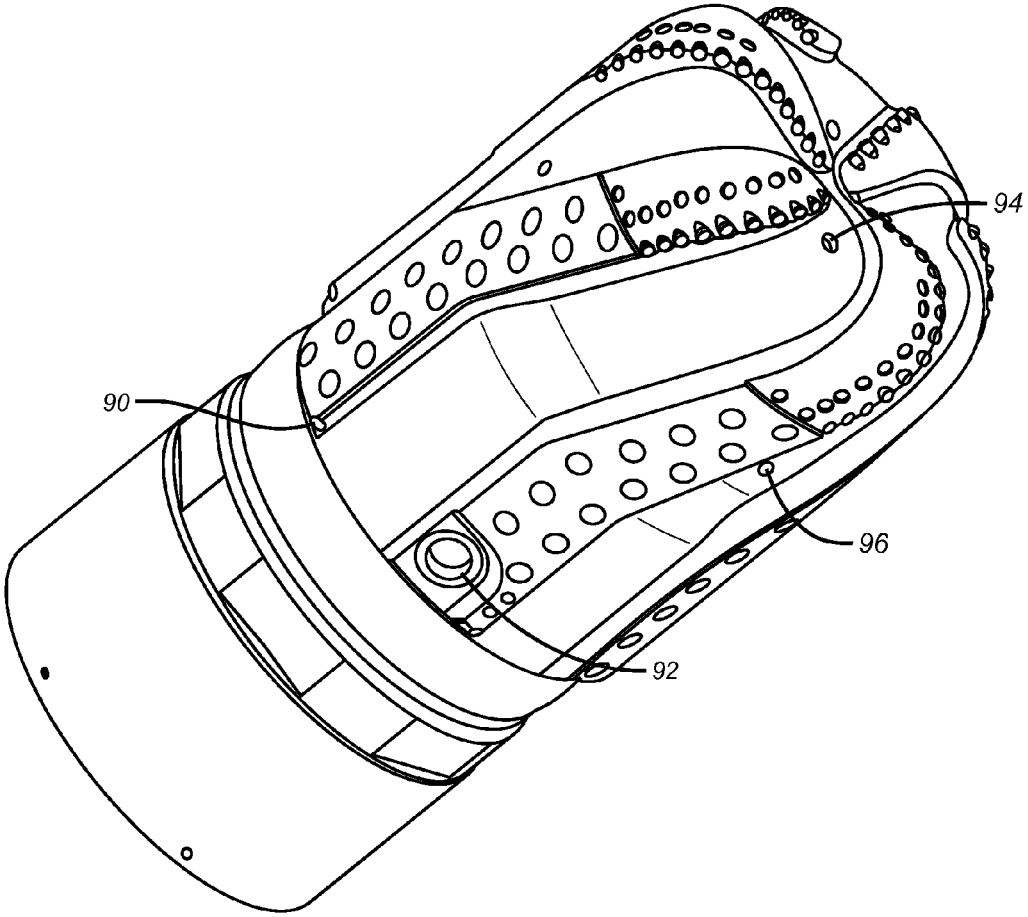
FIG. 7 is a perspective view of the reamer tool.

FIG. 3 takes the prior design of FIG. 1 but reconfigures it to address the torque fluctuation issue at the higher speeds of the turbine driver, shown schematically as T in FIG. 5, by still retaining the straight taper as before but by making it more blunt and shortening it to the point that the ratio of PL/BS is less than 0.75. By changing the taper angle from about 7 degrees to more than 30 degrees the mechanical advantage or aggressiveness is reduced by about 5:1. As before there is a gauge section 60 that is cylindrical. Two arcuate sections 62 and 64 are shown having respective radii of 66 and 68. As an option a single arcuate section with a single radius can be used instead of the two that are illustrated. A blunt, straight tapered section 70 disposed at an included angle 71 of at least 60 degrees follows leading to an arcuate shoulder transition section 72 with a nose radius 74 followed by a concave, straight segment 76 leading to the centerline 78. As before the bit size is measured in a plane perpendicular to the centerline 78 and is twice the distance from the centerline 78 to the gage section 60. The difference between FIGS. 1 and 3 is that the straight tapered section is greater than 30 degrees and reduced in length to shorten the bit length to the point where the ratio of PL/BS is less than 0.75. In this instance it is the recognition that shortening the PL for a given size which is preferably accomplished with blunting the taper and shortening the straight tapered segment results in a measurable decrease in torque fluctuation and stalling when rotating with a turbine or other comparable driver that attains speeds of 300-600 RPM or higher.

In the preferred embodiment the profile between the gage section and the nose is fully arcuate but an alternative can be a reconfiguration of the existing profile for a reamer tool shown in FIG. 1 by blunting the taper and shortening the PL to get the ratio of PL/BS of less than 0.75. Apart from altering the profile as discussed above, the reaming tool of the present invention has additional features discussed below to facilitate the reaming of partially obstructed or tortuous boreholes, the cleaning of debris and cuttings, protection of the existing or outer casing while tripping and finally additional secondary means to further increase the tool stability at the high rotational speeds when using turbines or similar drivers.

Referring to FIGS. 4-7 three blades 80, 82 and 84 extend into the central, concave cone section 86. This configuration ensures that drilling is feasible and material can be removed from the central portion of the reamer when the borehole is tortuous and/or severely compromised such as with debris or cuttings in an inclined or horizontal borehole, or where there has been a hole cave in or collapse due to tectonic stresses or inherently weak and damaged formations. The cutting structure of hard metal or polycrystalline diamond (PDC) inserts 88 in the central part 86 of the reamer and the junk slots and nozzles between blades 80, 82 and 84 promote cutting and adequate borehole cleaning through such obstructions.

Figure 4:
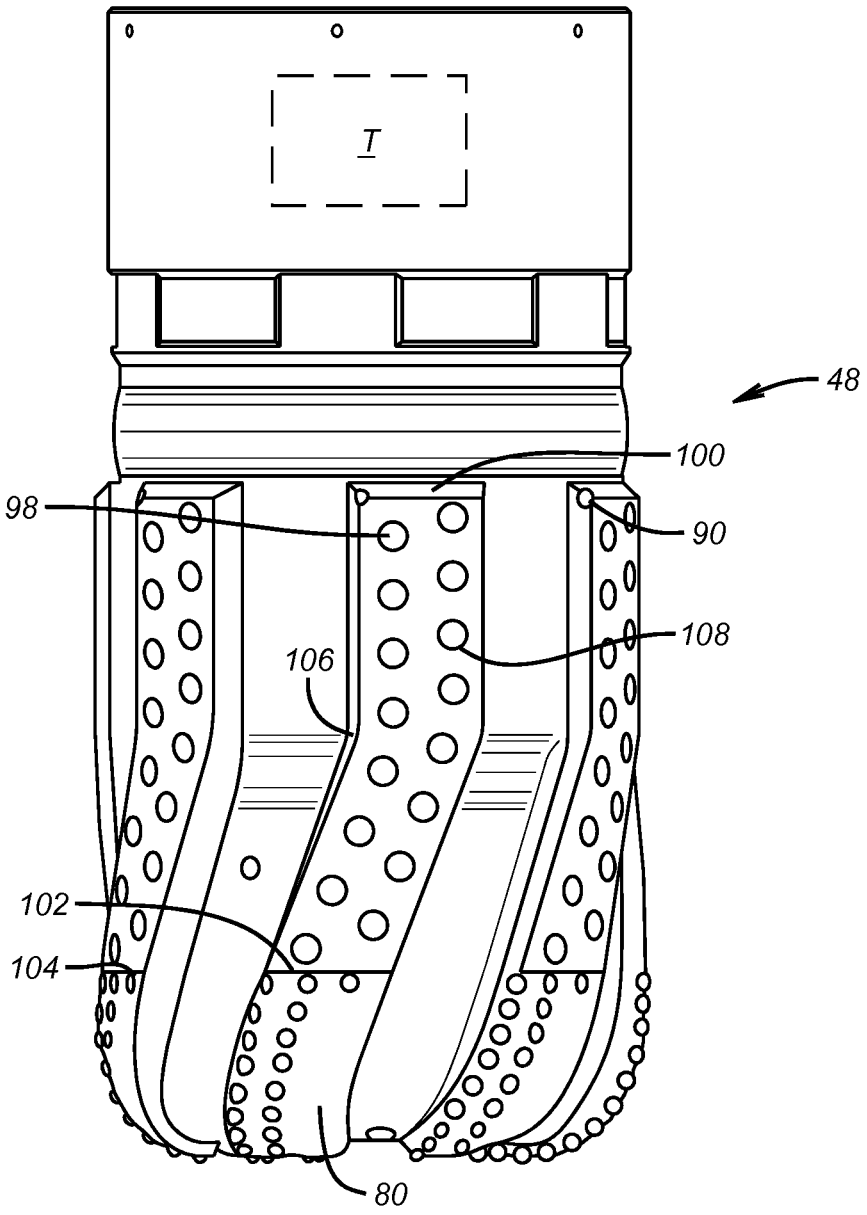
FIG. 4 is a front view of the reamer tool.
Figure 6:
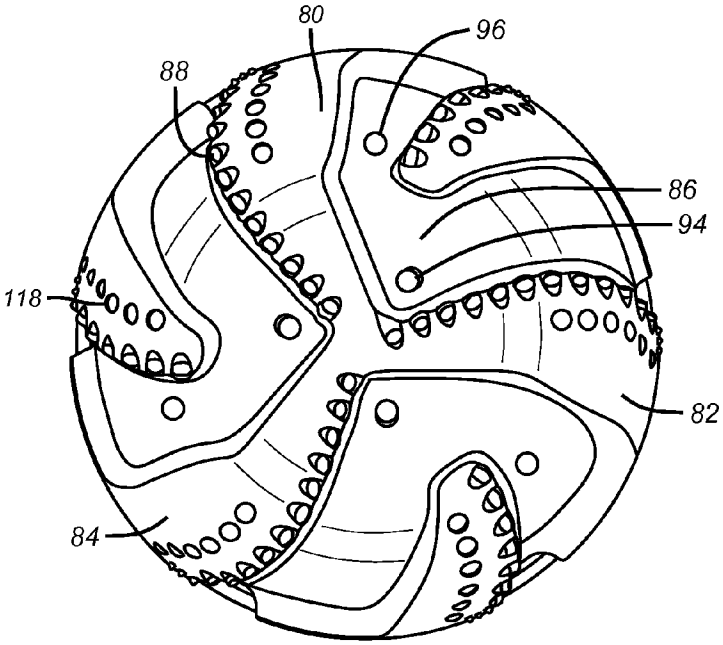
FIG. 6 is a top view showing the concave cone section of the reamer tool.

Referring to FIG. 4 the gage pads 98 extend from the top end 100 to the lower end 102. At the top end 100 there is a cutting element 90 at the leading side and near the top of all the blades which provides the ability to back-ream when removing the reamer in the event of hole collapse behind the reamer while drilling. This allows for easier up and down movement of the reaming tool and reduces the chances of getting stuck when short-tripping or conditioning the borehole through a tight section.

At the lower end there is a diametrical step up 104 of about 0.050 to 0.110 inches to transition to the blades 80 which have cutting elements on their leading side. The gage pads 98 are radially slightly smaller than the adjacent, actively cutting blades to assure smooth, passive contact with the borehole wall during rotation. They are partially spiraled with a bend 106 at the transition to the straight portion. The spiraling provides more circumferential contact and with the smooth surface and slight recess adds lateral stability to the reamer tool at high rotational speeds. An array of wear resistant, hard metal inserts 108 are inserted into the gage pad surface to provide wear resistance and maintain the critical gage diameter over the life of the reamer.

At step up 104 the gage pads transition into the actively cutting blades with primary hard metal or PDC cutting elements 88 at the leading edge. For drilling at high speed it is desirable to limit and control the depth of cut (DOC) or advance per revolution of the reamer to dampen both axial and torsional vibrations in mixed and interbedded formations. To control the depth of cut, a series of protrusions 112 and 114 are located generally behind and rotationally in line with the primary cutting elements 88. The exposure of these protrusions is less than that of primary inserts 88 and is adjustable based on the particular application. The protrusions 112 and 114 also protect the already existing, outer casing that the reamer may need to traverse before reaching the open hole segment to be reamed,' limit the side cutting aggressiveness and thus improve directional stability in inclined and horizontal wells. The protrusions can be hard metal or PDC inserts or appropriate shapes of hardfacing material welded to the outer surface of the blades. Another way to reduce the exposure of the primary cutting elements 88 is by depositing of a layer of hardfacing material across the entire outer blade surface or parts thereof.

Another important feature to reduce harmful torsional and lateral accelerations is the asymmetrical spacing of the blades to prevent the formation of a repetitive pattern on the borehole bottom and prevent the harmonics produced by evenly spaced blades. This is accomplished by having a standard deviation of at least 5 degrees in the angular spacing between blades.

The concave shape of the central part 86 of the reamer assures that it can be milled or drilled-out from the center to the shoulder without the risk of leaving any un-drilled parts downhole which could damage the next bit or bottom hole assembly.

One or more rupture discs 92 are provided with communication to the internal passages that lead to inner nozzles 94 and outer nozzles 96 so that in the event there is a nozzle obstruction and pressure builds up the rupture discs 92 will break and fluid circulation can continue uninterrupted. The inner nozzles are particularly important to assure adequate cleaning when the borehole is filled with excess cuttings from the reaming process itself or accumulation of cuttings in front of the reamer.

Those skilled in the art will appreciate that the reaming tool of the present invention designed to operate at speeds in the order of 300-600 RPM and higher has features that limit torque fluctuation using an arcuate profile between the gage section and concave cone section so as to eliminate an aggressive tapered section and shorten the profile length. An alternative design retains a straight tapered segment in the profile but the taper is greater than 30 degrees and the PL/BS ratio is smaller than 0.75 to shorten the height of the reaming tool and thus reduce torque fluctuation and stalling tendencies at high rotational speeds. The ability of the reamer to drill-out fully or partially obstructed holes is greatly enhanced by extending at least some of the blades with PDC cutting elements into the concave cone section and near to the center. Other features that aid the dynamic stability are asymmetrical spacing of the blades, depth of cut control through reduced exposure of the primary cutting elements and smooth spiraled and slightly recessed gage pads to restrict lateral motion. The row or rows of protrusions behind the primary PDC cutters promote not only dynamics stability but also reduce the side cutting aggressiveness when reaming an inclined wellbore and protect already existing outer casing when the next casing string with the turbine/reamer at its leading end is run into the borehole.

The above description is illustrative of the preferred embodiment and many modifications may be made by those skilled in the art without departing from the invention whose scope is to be determined from the literal and equivalent scope of the claims below:

We claim:

1. A high speed reaming tool for cleaning out and opening an existing borehole, comprising:

a tubular body;

a plurality of blades extending from the body with cutting elements on the leading edge defining a profile;

the profile extending from a cylindrical gage section through a shoulder section to the nose and into a central concave cone defined by a straight taper and disposed about a longitudinal axis of said body;

said profile having a length (PL);

at least some of said blades extend into said concave cone said body has a size (BS) defined by a diameter in a plane that is transverse to said axis and intersects said gauge section;

the ratio of PL/BS is less than 0.75.

2. The tool of claim 1, wherein:

an arcuate portion of said profile has at least one radius.

3. The tool of claim 1, wherein:

said profile is fully arcuate between said gauge section and said concave cone.

4. The tool of claim 1, wherein:

a plurality of gage pads extend from ends of each said blades, said gauge pads recessed from said diameter and further comprising wear resistant inserts, said cutting structure closest to said gauge pad extending radially away from said axis more than an outer face of said inserts.

5. The tool of claim 1, wherein:

a plurality of gauge pads extending from an end of each said blades, said gauge pads being slightly recessed with respect to said blades and an outer surface of said gauge pads, during use, being covered with smoothly ground wear resistant hardfacing.

6. The tool of claim 1, wherein:

said cutting elements of said blades located at the leading edge of said blades in the direction of rotation further comprising generally parallel rows of protrusions behind said cutting elements in the direction of rotation.

7. The tool of claim 1, wherein:

a plurality of gage pads extending diagonally from an end of each said blades, forming a bend and continuing into a straight section before reaching active cutting elements that provide an up-drill feature located on trailing ends of said pads.

8. The tool of claim 1, wherein:

said profile is arcuate between said gauge section and said concave cone and further comprises a second straight taper.

9. The tool of claim 1, wherein:

said blades are asymmetrically spaced about said axis.

10. The tool of claim 9, wherein:

said body is mass balanced.

11. The tool of claim 9, wherein:

said asymmetry is defined by a standard deviation of at least 5 degrees in the angular spacing of the blades.

12. The tool of claim 1, further comprising:

a turbine driver connected to said body for rotation of said body in a range of 300-600 RPM.

* * * * *